US008808521B2

(12) United States Patent
Zhou

(10) Patent No.: US 8,808,521 B2
(45) Date of Patent: Aug. 19, 2014

(54) INTELLIGENT CONTROL SYSTEM FOR ELECTROCHEMICAL PLATING PROCESS

(75) Inventor: Boli Zhou, Hillsborough, NJ (US)

(73) Assignee: Boli Zhou, Antioch, CA (US)

( * ) Notice: Subject to any disclaimer, the term of this patent is extended or adjusted under 35 U.S.C. 154(b) by 604 days.

(21) Appl. No.: 12/655,766

(22) Filed: Jan. 7, 2010

(65) Prior Publication Data

US 2011/0162969 A1 Jul. 7, 2011

(51) Int. Cl.
*C25D 21/18* (2006.01)
*C25D 21/14* (2006.01)

(52) U.S. Cl.
CPC ..... *C25D 21/14* (2013.01)
USPC ..... 205/101; 205/98; 205/99; 205/82

(58) Field of Classification Search
USPC ..... 204/228.6; 205/82, 98, 99, 101; 702/23; 700/266
See application file for complete search history.

(56) References Cited

U.S. PATENT DOCUMENTS

| | | | | |
|---|---|---|---|---|
| 4,326,940 | A | 4/1982 | Eckles et al. | |
| 4,694,682 | A | 9/1987 | Heikkila et al. | |
| 5,192,403 | A | 3/1993 | Chang et al. | |
| 5,985,126 | A | 11/1999 | Bleck et al. | |
| 6,156,167 | A | 12/2000 | Patton et al. | |
| 6,159,354 | A | 12/2000 | Contolini et al. | |
| 6,458,262 | B1 | 10/2002 | Reid | |
| 6,471,845 | B1 | 10/2002 | Dukovic et al. | |
| 6,474,845 | B1 | 11/2002 | Mabe et al. | |
| 6,645,364 | B2 | 11/2003 | Calvert et al. | |
| 6,726,824 | B1 * | 4/2004 | Khosla | 205/82 |
| 6,740,242 | B2 * | 5/2004 | Fukunaga et al. | 210/656 |
| 6,749,739 | B2 | 6/2004 | Chalyt et al. | |
| 6,827,832 | B2 | 12/2004 | Henuset et al. | |
| 6,857,118 | B2 | 2/2005 | Karr et al. | |
| 6,899,805 | B2 * | 5/2005 | Chen et al. | 205/794 |
| 6,973,644 | B2 | 12/2005 | Nylander et al. | |
| 6,993,772 | B2 | 1/2006 | Pike et al. | |
| 7,010,364 | B1 | 3/2006 | Singh et al. | |
| 7,022,212 | B2 | 4/2006 | Zdunek | |
| 7,051,333 | B1 | 5/2006 | Nylander et al. | |
| 7,051,338 | B1 | 5/2006 | Foti et al. | |
| 7,096,154 | B1 | 8/2006 | Andrade-Cetto | |
| 7,139,686 | B1 | 11/2006 | Critz et al. | |

(Continued)

OTHER PUBLICATIONS

International Search Report—PCT/US 11/00005, Mail date—Mar. 7, 2011, BZ Plating Process Solution.

(Continued)

*Primary Examiner* — Nicholas A Smith
*Assistant Examiner* — Brian W Cohen

(57) ABSTRACT

A method and system are disclosed for controlling plating bath compositions. Speciation analyzers including HPLC and mass spectrometry are employed to separate, detect, identify, and quantify additives and degradation products. A control unit is linked to a plating bath interface, analyzer interface, and valves to control the flow of plating bath to an analyzer sampler and back to plating bath. For each degradation product, a response output is determined for at least one performance factor in terms of an additive equivalent amount that produces the same effect. A data processing unit receives concentration data for additives and degradation products from speciation analyzers and calculates an amount of each additive needed to replenish a used bath. As a result, the bleed-and-feed ratio for maintaining plating baths can be substantially reduced with significant productivity improvement and cost savings in terms of chemicals, chemical disposal, less down time and improved product quality.

22 Claims, 4 Drawing Sheets

(56) References Cited

U.S. PATENT DOCUMENTS

| | | | |
|---|---|---|---|
| 7,165,253 | B1 | 1/2007 | Pike et al. |
| 7,170,433 | B1 | 1/2007 | Vetsch |
| 7,181,745 | B1 | 2/2007 | Foti |
| 7,228,239 | B1 | 6/2007 | Cetto |
| 7,231,631 | B1 | 6/2007 | Freeman et al. |
| 7,237,237 | B2 | 6/2007 | Foti |
| 7,270,733 | B2 | 9/2007 | Wikiel et al. |
| 7,291,253 | B2 | 11/2007 | Pavlov et al. |
| 7,340,441 | B1 | 3/2008 | Kumar et al. |
| 7,353,502 | B2 | 4/2008 | Stewart et al. |
| 7,359,805 | B1 | 4/2008 | Cetto |
| 7,365,311 | B1 | 4/2008 | Cetto |
| 7,369,127 | B1 | 5/2008 | Hull |
| 7,400,997 | B2 | 7/2008 | Edson |
| 7,428,737 | B1 | 9/2008 | Borghesani et al. |
| 7,454,659 | B1 | 11/2008 | Gaudette et al. |
| 7,454,746 | B2 | 11/2008 | Micco et al. |
| 7,460,123 | B1 | 12/2008 | Hull |
| 7,500,220 | B1 | 3/2009 | Feng et al. |
| 7,502,031 | B1 | 3/2009 | Pike et al. |
| 7,502,745 | B1 | 3/2009 | Shawver et al. |
| 7,523,023 | B1 | 4/2009 | Koh et al. |
| 7,523,440 | B2 | 4/2009 | Torgerson et al. |
| 7,529,652 | B1 | 5/2009 | Gahinet et al. |
| 7,531,134 | B1 | 5/2009 | Anderson et al. |
| 7,542,888 | B2 | 6/2009 | Critz et al. |
| 7,543,270 | B1 | 6/2009 | Grace |
| 7,558,712 | B1 | 7/2009 | Aldrich |
| 7,584,452 | B1 | 9/2009 | Johnson |
| 7,605,814 | B1 | 10/2009 | Critz |
| 7,606,780 | B1 | 10/2009 | Kumar et al. |
| 7,606,833 | B2 | 10/2009 | Shawver et al. |
| 7,609,192 | B1 | 10/2009 | Vetsch |
| 7,610,578 | B1 | 10/2009 | Taillefer et al. |
| 7,613,852 | B2 | 11/2009 | Orofino, II et al. |
| 7,624,372 | B1 | 11/2009 | Stewart |
| 7,631,168 | B1 | 12/2009 | Muellers et al. |
| 7,634,530 | B2 | 12/2009 | Dean et al. |
| 7,636,887 | B1 | 12/2009 | Kinnucan, Jr. |
| 7,640,154 | B1 | 12/2009 | Clune et al. |
| 2002/0033340 | A1 | 3/2002 | Cheung et al. |
| 2002/0125142 | A1 | 9/2002 | Sun et al. |
| 2003/0205476 | A1 | 11/2003 | Calvert et al. |
| 2004/0055888 | A1 | 3/2004 | Wikiel et al. |
| 2004/0108213 | A1 | 6/2004 | Talasek et al. |
| 2005/0006242 | A1* | 1/2005 | Andricacos et al. ..... 205/81 |
| 2006/0172427 | A1 | 8/2006 | Germouni et al. |
| 2007/0261963 | A1* | 11/2007 | Han et al. ..... 205/81 |

OTHER PUBLICATIONS

Analysis of copper plating baths—suppressors and levelers,: Proc. Electro-chem. Soc., by B. Newton et al., V200-27, p. 1, Dec. 2000.

"Ion-pair chromatography of bis (sodium-sulfopropyl) disulfide brightener in acidic copper plating baths," by R. Palmans, et al., Journal of Chromatography A, 1085, pp. 147-154 (2005).

"A New Metrology System of Organic Additives in Copper Electroplating Baths," by K. Hong et al., Journal of the Korean Physical Soc., vol. 43, No. 2, pp. 286-289, Aug. 2003.

"Automated mass spectrometry to detect impurities in harsh acid chemistries," by R. Mc Donald, Solid State Tech., vol. 49, Issue 6, Jun. 2006, pp. 1-5.

"Analysis of Copper Plating Baths," by B. Newton , 1998 IEEE/CPMT, International Electronics Manufacturing Technology Symposium, pp. 358-361.

"Analysis of Copper Plating Baths—New Developments," by B. Newton, 1999 IEEE/CPMT International Electronics Manufacturing Technology Symposium, pp. 203-206.

* cited by examiner

INTELLIGENT CONTROL SYSTEM FOR ELECTROCHEMICAL PLATING PROCESS

FIELD OF THE INVENTION

The invention relates to a method and system for controlling the chemical composition of an electroplating bath in order to reduce the cost of chemicals, lower the cost of disposing used bath solutions, and improve process reliability by minimizing the number of unexpected and unexplainable process outliers.

BACKGROUND OF THE INVENTION

Electrochemical plating is a process of depositing a metal layer on a metallic or non-metallic substrate. The technology is used in a variety of industrial applications including integrated circuit fabrication, semiconductor packaging, printed circuit board manufacturing, metallic coating and finishing, and others. In an electroplating process, an electric current is passed through an electroplating cell comprised of a working electrode (cathode), counter electrode (anode), and an aqueous electrolyte solution of positive ions of the metal or metals to be plated on a substrate in physical contact with the cathode. By applying a potential to the electrodes, an electrochemical process is initiated wherein cations migrate to the cathode and anions migrate to the anode. Metallic ions deposit on a substrate attached to a cathode to form a metal coating.

In semiconductor applications, the plating of metals such as Au, Sn, Cu, and Pb is used for packaging and printed circuit board products. In particular, a dual damascene Cu plating method is commonly employed to fabricate metal lines for integrated circuits. Typically, a seed layer is sputter deposited in openings to line the sidewalls and bottom surfaces of vias and trenches. Then, an electroplating process fills the openings, preferably in a direction from bottom to top to avoid formation of pin holes or voids that can degrade device performance.

U.S. Pat. No. 6,156,167 discloses an apparatus for electrochemically treating semiconductor wafers and U.S. Pat. No. 6,159,354 describes an electric potential shaping method for electroplating that can be implemented in a dual damascene copper process. In addition, U.S. Pat. No. 5,985,126 describes a semiconductor workpiece holder used in electroplating systems. Conventional manufacturing processes generally comprise at least a plating cell, post-plating module, wafer handling device, wafer transfer mechanism, plating bath, and a chemical monitoring device and dosing system.

In addition to inorganic constituents in the form of metal salts, plating baths contain organic additives required for achieving the desired deposition properties. Types of organic additives include a suppressor otherwise known as a carrier or wetting agent, a brightener also known as an accelerator, grain refiner, starter, etc., and a leveler also referred to as a leveling agent, momentum deposition reducer, etc.

A consequence of the electroplating operation is degradation of the organic species over time. As additives degrade, their concentrations deviate from the nominal (or target) value. Moreover, the accumulation of degradation products may adversely affect the properties of the deposited metal film. For example, carbon, nitrogen and sulfur may be incorporated in a Cu film and thereby lower electrical conductivity.

Several methods have been proposed to maintain the consistency of organic additives in a copper plating bath. U.S. Pat. No. 6,458,262 describes a method of removing organics from the plating bath and analyzing the reconstituted organic fraction with high pressure liquid chromatography (HPLC). The deviation of the measured result from the additive target concentration is the amount to be replenished.

U.S. Pat. No. 6,471,845 describes a Smart Dosing method to compensate for consumption of additives in a plating bath. A bath maintenance feature mathematically predicts concentration changes in additive species based on the assumption that a given additive may degrade linearly due to the passage of time and charge. The predictive algorithm compares the predicted concentration of a species to its nominal concentration and calculates a quantity of the additive from a dosing reservoir that would be required to reset the bath. A metering pump for that additive species is then activated and the required dose is administered to a central bath reservoir. However, Smart Dosing does not perfectly compensate for additive consumption. As a result, actual analysis of batch constituents should be performed periodically. If measured concentrations are below the target values, additives will be added as corrective dosing.

Corrective dosing requires analytical instruments and methods to quantify the amount of additives in a plating bath. U.S. Pat. No. 5,192,403 relates to a cyclic voltammetry scan (CVS) method for measuring concentration of a plating bath component. U.S. Pat. No. 7,270,733 discloses a method involving chemometric analysis of voltammetric data and is commonly referred to as RTA (Real Time Analyzer). U.S. Pat. No. 7,531,134 describes an apparatus utilizing isotopically labeled spikes, an electrospray ionizer, and mass spectrometry to characterize concentrations of plating solution constituents.

As a plating bath ages during usage, the amount of degradation products increases and it is generally recognized that contamination from atoms such as carbon, nitrogen, and sulfur in deposited metal films rises as a result. Reduction of the contamination is accomplished by "bleed-and-feed" in which a certain fraction of plating solution is dumped and replaced with fresh materials. U.S. Pat. No. 6,471,845 points out that with the bleed-and-feed approach degradation products can reach limiting (or steady state) concentrations where they will not degrade the process. In U.S. Pat. No. 6,827,832, an electrochemical process is disclosed to break down and remove degradation compounds and refresh additives in a plating bath.

As for the additives, the suppressor is typically a polyethylene glycol (PEG) or a block copolymer of polyethylene oxide (EO) and polypropylene oxide (PO) and it absorbs on a copper cathode aided by the chloride present in the bath solution. The suppressor functions as an inhibitor of field deposition to facilitate bottom-up and void-free fill in dual damascene Cu plating and through silicon via, and also serves as a surface wetting agent to reduce deposition defects caused by lack of contact between plating solution and substrate. The suppressor breaks down into lower molecular weight fragments during wafer processing.

The accelerator is typically a sulfur containing organic species such as thiourea, cystine, 2-mercaptoethylsulfonate, 3-mercaptopropylsulfonate, and dimers of some sulfur derivatives. Accelerator functions include promoting bottom-up fill in dual damascene interconnects and through silicon via, and refining deposited metal grain structure. An accelerator is likely to be oxidized during plating operations to sulfones, sulfoxides, sulfonates, and other products with higher oxidative states.

A leveler is usually a nitrogen containing polymer that reduces momentum deposition over trench, via, and recessed areas on a substrate. A leveler may undergo reductive or oxidative reactions during plating. Degradation products of suppressor, accelerator, and leveler may possess their own electro activity and thereby influence an electroplating process.

One shortcoming of electrochemical analytical techniques such as CVS and RTA is that they are not very selective. CVS and RTA measure quantities related to charges that pass through analytical electrodes under analytical conditions but such charges are not exclusively dependent on concentrations of additives being measured and can be merely a combined effect of all bath constituents. Therefore, additive concentrations detected by CVS and RTA are not true additive concentrations in an aged plating bath where degradation products exist. Instead, they represent the combined analytical electro effect of additives and degradation products expressed in terms of concentrations of pure additives. Referring to FIG. 1, suppose an actual bath solution contains 5 mg/liter additive and 10 mg/liter degradation products while a hypothetical bath contains 5 mg/liter plus 3 mg/liter additive and no degradation products. Both of the hypothetical and actual baths have the same measured response on the two electrochemical analyzers, respectively. CVS or RTA then reports out additive concentration in the hypothetical bath (5+3=8 mg/liter) as a representation of the actual bath additive composition. CVS and RTA further assume that the hypothetical bath would have the same process output during wafer processing on a plating tool as the actual bath because they have the same analytical response on the analyzers. A chemical process control system for a plating bath using RTA is disclosed in U.S. Patent Application 2006/0172427.

Electrochemical response is a complex process and involves variables related to surface activity, substrate type, molecular structures of surface active materials, mass transport, redox potentials and activation energies, etc. Actually, elements of an electroplating process are very different from those of CVS or RTA. Further, elements of CVS are different from those of RTA. For example, the electrode substrate in CVS and RTA is Pt while in copper plating it is Cu. In CVS and RTA, the electrode is flat, and also rotates in the case of CVS. In dual damascene copper plating, the electrode surface is blanket copper film over topography that includes vias, trenches and recesses. Current density and electrode potentials in analysis and wafer processing are not equivalent. Wafer processing typically uses a galvanostatic approach while CVS and RTA take a potentiostatic path. U.S. Pat. No. 7,022,212 shows an analytical method to simulate actual conditions on a wafer and to measure additive concentration and mass transfer of plating components to control a plating bath composition.

CVS and RTA analytical response is an average over localities across an electrode surface. On the other hand, in Cu dual damascene, process response such as bottom-up fill is a local event driven by accumulation of accelerator at the bottom of features due to surface area reduction as plating progresses according to one theory. Bottom-up fill is also a function of the intrinsic ability of accelerator to displace suppressor adsorbed on a copper surface unlike CVS and RTA where suppressor is displaced from platinum.

Clearly, it is questionable and an oversimplification to assume that degradation products which produce a CVS or RTA analytical response equivalent to a certain amount (X) of fresh accelerator (or other additive) will also generate the same response as an X amount of fresh accelerator in a plating process. In fact, it is extremely unlikely that this relationship would occur in a large variety of electroplating operations practiced in the industry. Moreover, there is plenty of evidence to support the opposite conclusion. For instance, CVS results in an aged bath do not agree with those from RTA. This outcome can be caused by a variation between CVS and RTA analytical conditions which then leads to a different analytical electro response for a given amount of degradation products.

Although selectivity of CVS and RTA was improved in recent years to a point where CVS and RTA are now the preferred choices for bath monitoring in the plating industry, selectivity improvement is still limited by two fundamental realities. One is that with an inherently poor selectivity methodology and increasing number of active components (e.g. degradation products) present in solution, there is a limitation to how well interference of one additive by other constituents can be separated. Secondly, separation of interference in electrochemical analysis requires availability of pure materials for analytical method development. For example, pure samples of accelerator degradation products are needed to exclude their effect from the total CVS or RTA sensor response so that accelerator only response can be derived for determining accelerator concentration. However, those degradation products are rarely identified and cannot be sourced in most cases. Therefore, the analytical result from CVS or RTA relative to suppressor, accelerator, or leveler is in fact the total analytical electro response from the species being analyzed and degradation products that is exhibited during analysis, although the response is expressed in terms of concentration of pure additive that would have produced the same analytical electro activity under the same analytical condition in the absence of degradation products.

Chromatography methods have been applied to analyze organic additives as mentioned by B. Newton et al. in "Analysis of copper plating baths suppressors and levelers", Proc. Electrochem. Soc., V2000-27, page 1, Dec., 2000, by R. Palmans et al. in "Ion-pair chromatography of bis(sodiumsulfopropyl)disulfide brightener in acidic copper plating baths", Journal of Chromatography A, 1085, pp. 147-154 (2005), and by K. Hong et al. in "A new metrology system of organic additives in copper electroplating baths", Journal of the Korean Physical Soc., Vol. 43, No. 2, pp. 286-289, Aug., 2003.

Mass spectrometry was also reported to be applicable to plating bath analysis by R. Mc Donald in "Automated mass spectrometry to detect impurities in harsh acid chemistries", Solid State Tech., Vol. 49, Issue 6, Jun., 2006.

Arguments have been made by established industry participants that conventional quantitative analytical chemistry techniques such as HPLC and mass spectrometry are not appropriate choices for monitoring a plating bath because they do not include electro activity of degradation products in reported additive concentrations which are used as input variables to control a plating bath process. As a result, analytical technology based on HPLC and mass spectrometry which is popular in chemical, pharmaceutical, and biotechnology industries has been used sparingly in the electroplating industry. However, some chemical species resulting from additive degradation in plating baths do possess electro activity and could have a significant impact on the electrochemical response of a plating bath. For example, one of the common suppressing agents, high molecular weight polyethylene glycol (PEG) breaks down into low molecular weight PEG which is known to have CVS activity according to U.S. Pat. No. 6,749,739. Also, 3-Mercaptopropyl sulfonic acid (MPSA) is produced electrolytically as a degradation product of bis(sodiumsulfopropyl)disulfide (SPS), an accelerator. U.S. Pat. No. 7,291,253 indicates a CVS activity for MPSA higher than that of SPS under the same analytical condition.

A current practice in the electroplating industry is to rely on the bleed-and-feed approach where usually 10% to 30% of a bath reservoir is drained and replaced by fresh solution each day to maintain degradation products at a steady state level. Therefore, plating baths are expected to have consistent process performance over time under bleed-and-feed conditions when bath additive concentrations are supposed to be kept at a constant level. Since current electroplating processes are known to produce unexpected results when a bath becomes aged and the only solution in such an event is to dump the bath, this occurrence suggests that certain elements of the bleed-and-feed process chemistry are not controlled and understood.

Referring to FIG. 2, the amount of degraded additive present in a bath after a certain number of processing days is expressed in terms of a % of the nominal concentration. The plots for bleed/feed rates of 10%, 20%, and 30% assume a production environment including 60 wafers/hour throughput, 70% utilization, and 90% uptime. The amount of degradation products existing under steady state in copper plating processes range from 0 to 1.6 times the target additive concentration. Within this concentration range, the electro activity of degradation products probably represents a small portion of total electro activity and its rise and fall due to fluctuation in degradation product content over time is tolerated by the process. In the Palmans reference cited previously, results showed that additive concentration in a bath presumably kept stable by electrochemical analytical techniques had approximately ±50% variation from an average value. Although significant, such concentration variation may be tolerated by the process.

Curves 20, 21, 22 in FIG. 2 indicate an increasing amount of degradation products with reduced bleed-and-feed. This condition can thus create a bath with sufficient degradation products to cause a rise and fall in additive concentration wherein the fluctuation leads to process variability. In other words, a bath kept at constant total analytical electro response may see sufficiently large additive concentration fluctuation to impact deposition because of the variation in degradation composition associated with reduced bleed-and-feed. Consequently, it is likely that unexpected and unexplainable process outliers will become more frequent if the bleed-and-feed rate is reduced. In summary, the necessity of a 10%-30% daily bleed-and-feed and associated material related cost may be precipitated by using non-selective analytical electro activities as input variables for bath chemistry control.

Unfortunately, current control methodology for electroplating processes that rely only on electrochemical analytical techniques are not sufficiently reliable to reduce dependence on the bleed-and-feed approach which costs billions of dollars worldwide because of the expense incurred with a high volume of replenished components and frequent disposal of up to 10% to 30% of the plating solution. Furthermore, current production processes are still subject to unexpected and/or unexplained performance failures even with in-control bath chemistry. The only solution is to dump and renew the entire bath which drives material cost higher and presents a process reliability issue. Therefore, an improved electroplating process control system and methodology is needed to reduce production cost and improve reliability.

SUMMARY OF THE INVENTION

One objective of the present invention is to provide an integrated process control method comprised of separating, detecting, identifying, quantifying, and determining electrochemical activity of degradation products in an electroplating solution so that the additive equivalent amount of a degradation product can be calculated and used to control the replenishment of additives in the plating solution.

A further objective of the present invention is to provide an intelligent control system that includes components for separating additives from degradation products, detecting individual bath components, measuring degradation product and additive concentrations, quantifying the effect of bath components on process output, and controlling the amounts of additives used to replenish an electroplating bath.

According to one embodiment of the present invention, additives and degradation products in an electroplating bath are separated, detected, identified, and quantified by one or more analytical speciation techniques such as HPLC, ultra-HPLC (UHPLC or ULPC), UV-VIS spectroscopy, FT-IR spectroscopy, near IR spectroscopy, Raman spectroscopy, nuclear magnetic resonance (NMR), and mass spectrometry. The concentration of each additive and degradation product is measured and one or more response outputs related to performance are determined which are subsequently used to calculate an additive equivalent amount for replenishing an additive in the plating solution. A portion of an electroplating solution in a plating cell or in a reservoir that supplies a plurality of plating baths is collected through a fluid interface to the plating solution or a reservoir and is transported to a speciation analyzer through a second fluid interface. According to one embodiment, a small fraction of plating bath fluid may be distributed by an analyzer sampler simultaneously to a plurality of the aforementioned analytical instruments as well as electrochemical analytical tools including CVS and RTA so that electrochemical measurements may be taken at the same time as analytical speciation techniques are performed. Alternatively, a portion of the plating bath fluid may pass through a HPLC and be separated into a plurality of chemical species before electrochemical measurements and other analytical methods are performed on the pure constituents. In one aspect, multiple HPLC columns having one or more mobile phases may be employed to analyze a single plating bath sample and a plurality of detectors may be used to detect, identify, and measure the individual constituents including additives and degradation products separated on multiple columns. Moreover, one or more additional analytical speciation techniques may be performed on the one or more individual constituents obtained from a HPLC separation process to aid in the detection, identification, and quantification steps. Thus, one or more additives and one or more degradation products may be separated, detected, identified, quantified, and an electrochemical activity determined for each from a single plating bath sample.

Once each plating bath constituent has been characterized during a set up phase, the process of maintaining a plating bath in a manufacturing control phase may begin. A plurality of samples are collected during a manufacturing process and analyzed using previously developed techniques to determine the amounts of degradation products and additives, and then calculate the amount of additive needed to keep the electroplating output within preset boundaries. Thus, a continuous monitoring process of the plating bath is established and the data output is recorded in a quality control system. After each analysis is completed, the collection of analytical instruments (analyzer) transfers the data to a data processing unit which transforms the data into a new set of data comprised of input variables that a plating tool interface recognizes in order to replenish additives. The data processing unit is also interfaced with factory automation equipment where quality control records are maintained and reviewed by manufacturing personnel.

A key feature of the present invention is the concentration and output response of each degradation product are measured and correlated to an equivalent amount of additive that would produce the same effect in the plating solution. The information relayed from the data processing unit to the plating tool controller includes input variables related to an addition amount of additive that is dependent not only on an actual additive concentration as measured by a combination of analytical speciation techniques, but also on the concentration of degradation products as determined by the aforementioned analytical methods. The amount of each additive needed to replenish the plating bath or reservoir to maintain an additive concentration and the plating process within a tight control is represented by $\Delta$=Nominal concentration—Measured concentration where Addition amount=$\Delta+C_F$ in which an additive equivalent amount $C_F$ is determined by a sum of contributions from each degradation product as in $C_{F\ Total}=C_{F\ DP1}+C_{F\ DP2}+C_{F\ DP3}\ldots+C_{F\ DPn}$ where n is an integer and each of $C_{F\ Total}$, $C_{F\ DP1}$, $C_{F\ DP2}$, $C_{F\ DP3}$, and $C_{F\ DPn}$ may be a negative value, zero, or a positive value. In other words, the amount of additive to be added to a bath is determined by two factors which are the actual additive concentration measured in the bath and the amount of degradation products in the bath. In particular, for a specific output response such as deposition rate, film roughness, or electrical conductivity, the effect of a measured amount of degradation product is equated to a certain amount of additive that will provide the same output response.

Alternatively, the amount of additive to be added to reset the plating bath can be expressed as Addition amount=$a_i^{t-a}{}_i$. The term $a_i^t$ is the target concentration of an $i^{th}$ additive when degradation products are present, and $a_i$ is the measured additive concentration. Furthermore, $a_{hu\ t}$ can be mathematically obtained from the equation $f(a_1^t, a_2^t, a_3^t - - - a_i^t, d_1, d_2, d_3 - - - d_j)-f(T_1, T_2, T_3 - - - T_i, 0, 0, 0 - - - 0)=0$ where f is the functional relationship between an output response and bath composition, $d_j$ is the concentration of the $j^{th}$ degradation product, and $T_i$ is the nominal concentration of the $i^{th}$ additive when the bath is free of degradation products. The correlation between $a_i^t$, $T_i$, and $C_{F\ Total}$ is $C_{F\ Total}=a_i^t-T_i$.

In summary, the amount of additive to be replenished can be obtained by Addition amount=$\Delta+C_F$=Nominal concentration−Measured concentration+$C_{F\ Total}$ or Addition amount=$a_i^t-a_i$. $C_{F\ Total}$ can be obtained by $C_{F\ Total}=C_{F\ DP1}+C_{F\ DP2}+C_{F\ DP3}\ldots+C_{F\ DPn}$ or $C_{F\ Total}=a_i^t-T_i$. To be consistent with how electroplating tools are currently designed to receive bath concentration information to determine amount of additives to be dosed, it is preferred to use Addition amount=$\Delta+C_F$=Nominal concentration−Measured concentration+$C_{F\ Total}$. In such case, there is no need to change plating tools' software and the term (Measured concentration−$C_{F\ Total}$) is the input variable to be transmitted from the intelligent control system to plating tools.

DETAILED DESCRIPTION OF THE INVENTION

Figure 1:
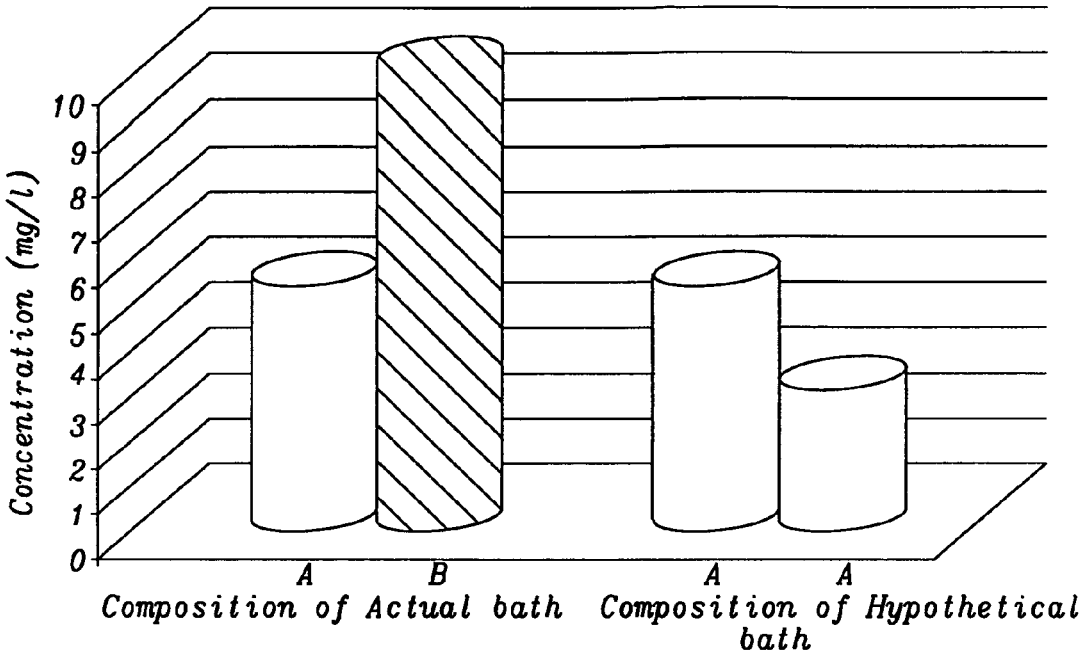
FIG. 1 is a plot showing that a hypothetical plating bath containing only additive may generate the same response output as an actual bath containing both additive and degradation product in a typical CVS or RTA analytical technique.
Figure 2:
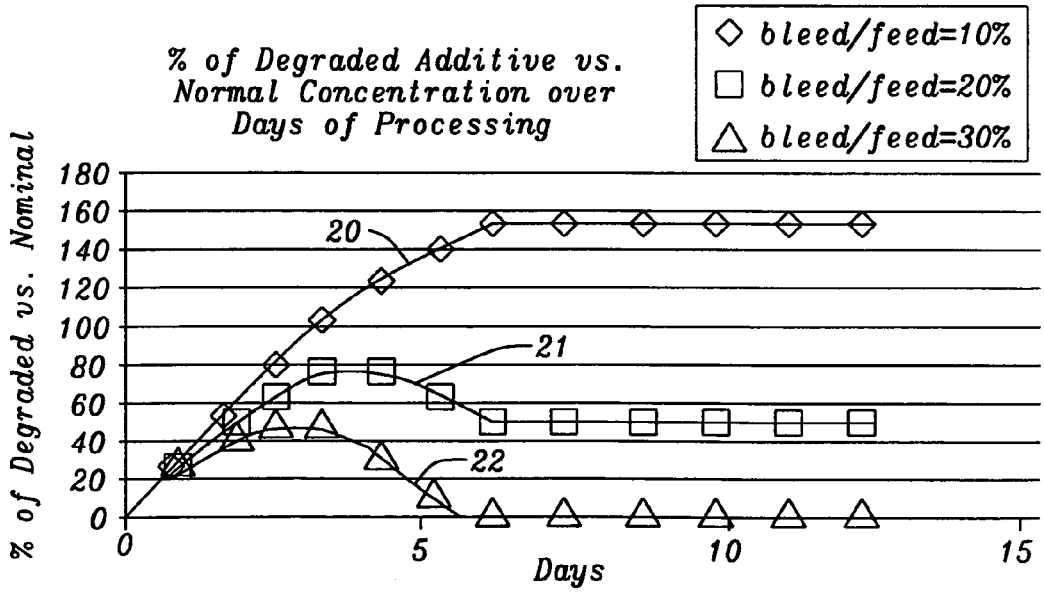
FIG. 2 is a plot that shows % of degraded additive vs. nominal concentration as a function of time and the bleed-and-feed ratio.

The present invention is a method of controlling an electroplating operation that includes detecting, identifying, and quantifying degradation products by separation and analytical techniques, determining an output response related to at least one performance aspect, and calculating an equivalent amount of additive that would produce the same effect as the measured amount of degradation product. The terms electroplating, plating, and electrodeposition may be used interchangeably. Furthermore, an electroplating bath may also be referred to as an electroplating solution, electroplating cell, bath sample, or plating bath. Analytical instruments in the present invention relate to systems with or without one or more separation units and may be referred to as speciation analyzers. The present invention also encompasses an intelligent control scheme that includes various pieces of equipment and communication links between process components that enable the control system to use data from an analyzer to control an electroplating process with improved reliability and lower cost of process materials. The embodiments described herein are essentially independent of electroplating cell design and relate primarily to controlling the composition and performance of an electroplating solution as supplied from a reservoir that feeds multiple electroplating solutions or within a stand alone electroplating apparatus. Additives are defined as suppressors, leveling agents, and accelerators, and may also include buffering agents, surfactants, stress reducing agents, and other materials used in plating solutions to enhance performance.

As stated earlier, HPLC, mass spectrometry, and other common laboratory analytical instruments have been used sparingly to control an electroplating operation because of the popular conclusion that techniques which are not based on electrochemical response are not valuable in monitoring an electrodeposition process. On the other hand, electrochemical techniques such as CVS or RTA do not sufficiently speciate bath constituents in plating solutions containing degradation products. Moreover, analysis of degradation products in an electroplating bath and determination of their effect on the plating process are very challenging because of the complexity of the electroplating chemistry.

One important feature of the present invention is an integrated control process for separating, detecting, identifying, quantifying, and determining an output response for a plurality of degradation products in an electroplating bath so as to offer improved process control over a control system that only monitors an overall electro activity response and does not account for degradation products. As disclosed herein, the concentration of degradation products and additives is monitored on a regular basis and the effect of degradation products on output response is determined in order to calculate the appropriate amount of additives needed to replenish the electroplating solution and maintain a consistent high quality electroplated film. The intelligent control system comprised of speciation analyzers, control unit, data processing unit, and interfaces to plating solution, plating tool, and factory automation equipment will be described in a later section.

According to one embodiment, the integrated control process includes a "set up" phase and a manufacturing control phase wherein each phase comprises a plurality of speciation analyzers such as HPLC, UHPLC or UPLC, mass spectrometry, CVS, RTA, NMR, Fourier transform infrared (FT-IR), near IR, UV-VIS spectrometry, and Raman spectroscopy. HPLC and UHPLC may come with or without equipped detectors such as UV-VIS, mass spectrometry, electrochemical, refractive index and/or evaporative light scattering detectors. The "set up" phase includes methods and experiments that may be performed to develop a methodology which can be repeatedly applied in an actual manufacturing environment such as separation methods, detection methods, identification methods, quantification methods, and methods to determine the effect of a degradation product on an electroplating process output.

With regard to separation methods, HPLC may be employed as a method to separate chemical species in an electroplating bath so that individual constituents can be identified and characterized. HPLC typically involves a column packed with a stationary phase and a pump that moves a mobile phase containing solvents and plating solution through the column. Each of the chemical species in the mobile phase has a different retention time (time needed to pass through the column) based in part on the size and polarity of the chemical structure. One or more detectors such as a UV-VIS detector set at one or more wavelengths, a refractive index detector, an electrochemical detector, an evaporative light scattering detector, or a mass spectrometry detector are used to generate a response output in the form of a chromatogram that has peaks with different intensities depending on the concentration and response factor of each chemical species in the detector. When the mobile phase exits the column, various fractions corresponding to the different peaks in the chromatogram may be detected, collected, and identified or characterized by using another speciation analyzer. The word "collection" as defined in the present invention refers to passing of a mobile phase through at least one column and monitoring of peak materials by one or more speciation analyzers, or physical collection of peak materials in a sample container for subsequent analytical work. Preferably, each fraction contains only one chemical species so as not to complicate the identification or characterization processes. In one aspect, the plating solution sample introduced into the HPLC mobile phase is substantially aqueous with a plurality of organic additives and degradation products. If individual organic chemical species are to be identified and characterized, water is preferably removed from the collected fractions since water is not compatible with some types of speciation techniques such as NMR and FT-IR. The organic solvent may be removed by evaporation from each collected fraction to leave an essentially pure chemical species for subsequent analysis.

According to one embodiment, a circulation loop for obtaining sample plating solution is comprised of a plating bath interface with two ports connected by two three way valves. In one aspect, plating bath solution flows through the first port, first and second three way valves, and then back through the second port into the plating bath reservoir, for example. There is also a second circulation loop connected to the first circulation loop that enables a certain portion of plating solution to be transported to an interface sample reservoir that feeds an analyzer sampler. The second circulation loop includes a first shut off valve between the first three way valve and the interface sample reservoir and a second shut off valve between the interface sample reservoir and the second three way valve. Plating solution from the interface sample reservoir is transported to an analyzer sampler by using a circulation pump as explained in a later section. Thus, plating solution may be withdrawn through a fluid interface to a plating bath reservoir and moved through a circulation system to a fluid interface to analyzer sampler where it is periodically distributed to a plurality of speciation analyzers. The analyzer sampler may be a part of or independent of the analyzer systems it serves.

In a preferred embodiment, the analyzer sampler supplies a plating bath solution sample to a HPLC instrument for separating, detecting, identifying, and quantifying the plating bath constituents. Furthermore, other speciation analyzers in combination with HPLC may be employed to detect, identify, and quantify a chemical species. For example, a collected fraction of pure constituent obtained from HPLC may be analyzed by a mass spectrometer to aid in the detection, identification, or quantification process. It should be understood that the analyzer sampler may direct a portion of plating bath to only one speciation analyzer or simultaneously to a plurality of speciation analyzers. In addition, the HPLC speciation analyzer may include multiple columns to analyze a single sample wherein each column has a different stationary phase that differs in terms of polarity and/or size of the stationary material component. It should be understood that columns having a substantially non-polar stationary phase may be more effective in separating certain components that tend to have the same retention time in columns with a substantially polar stationary phase, and vice versa. Thus, one separation process may occur in a first HPLC column to separate chemical species W and X that have the same retention time in a second HPLC column while the second column is used to separate chemical species Y and Z that have the same retention time in the first column.

Figure 3:
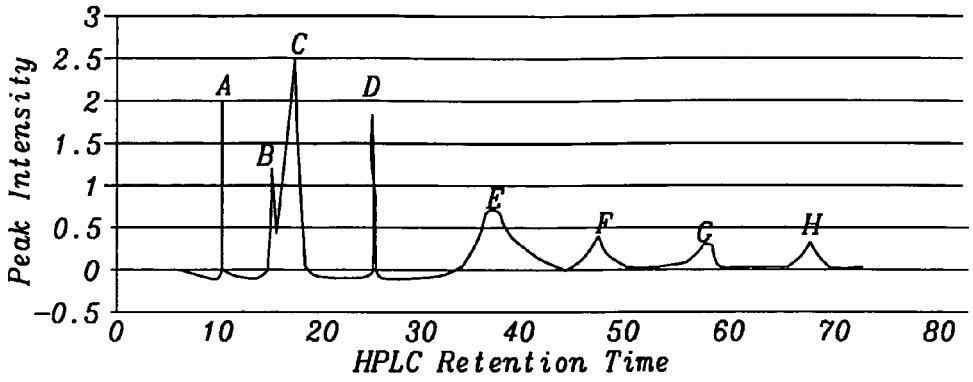
FIG. 3 illustrates a HPLC chromatogram which is one speciation technique that is used as a method of separating, detecting, identifying, quantifying, and monitoring degradation products in an electroplating bath according to an embodiment of the present invention.

Referring to FIG. 3, a sample HPLC chromatogram is depicted that has eight chemical constituents or species identified as A through H. Note that each constituent has a different retention time expressed in units of time, and a peak intensity that is related to its concentration. In this example, chemical species A and D-H are sufficiently separated from one another to allow subsequent detection, identification, and quantification methods to be performed. However, chemical species B and C have peaks that overlap which will likely, in preparative separation, require a different stationary phase or different HPLC column conditions related to mobile phase, temperature or pressure (or flow rate) to achieve an efficient separation, although the overlap may be resolved in analytical quantification through various baseline manipulation techniques for peak area calculation. Preferably, a separation method is developed for each additive and degradation product to allow an essentially pure sample to be collected on at least one HPLC column. Thereafter, a sufficient number of analytical speciation techniques are applied to detect, identify and quantify each constituent that has been separated from a plating bath solution.

In one embodiment, identification involves spiking a known compound in an electroplating solution sample to verify that it has the same HPLC retention time as one of the constituents A-H, for example. Alternatively, the response output for a known structure on one or more speciation analyzers is matched to that of a constituent from the plating bath solution to verify an identity (i.e. structural characterization or elucidation). Those skilled in the art will appreciate each analytical instrument (speciation technique) provides unique information about a chemical species. $H^1$ NMR is usually relied upon to determine the type and number of protons in a chemical structure. FT-IR provides information about the presence of functional groups such as hydroxyl (OH), carbonyl (C═O), and acid (COOH) moieties in an organic species. Mass spectrometry reveals the molecular weight of a chemical substance and the types of fragments produced when subjected to high energy conditions that can break covalent bonds. Structural characterization methods may be performed during a manufacturing control phase of electroplating but are not preferred during manufacturing processes since identification of an unknown species can be time consuming and a considerable amount of costly down time in the plating tool may result.

Quantification methods are used to measure the concentration of an additive or degradation product in an electroplating bath and may be performed in conjunction with or without a separation method. The term "concentration" in the present invention refers to concentration as defined in chemistry textbooks or un-calibrated sensor response such as intensity of spectroscopic peaks. In one embodiment, HPLC may be utilized to perform separation and quantification. HPLC instruments are capable of measuring the area below each peak A-H in FIG. 3, for example, and area of each peak is related to concentration of the chemical species based on a response factor or curve that may be independently derived in a separate experiment. According to another embodiment of the present invention, HPLC is used to isolate one or more chemical species which are later quantified with another analytical technique such as mass spectrometry or NMR. Quantification in some cases requires spiking a known amount of a chemical compound or reference in a sample and determining the intensity of response output of the reference with respect to the chemical species to be quantified. According to the integrated process control method described herein, it is often necessary to separate individual constituents so that an output response related to concentration for each constituent can be effectively measured without interference from other chemical species which is referred to as selectivity in the field of analytical chemistry. Thus, selectivity is critical in overcoming a shortcoming of prior art electroplating process control methods based only on CVS and RTA techniques in which interference from one component cannot be separated from other components (particularly degradation products) and an output response represents the combined contribution of all chemical species with electro activity. The integrated process control embodiments of the present invention enable a more thorough understanding of the chemical species in an electroplating solution and their individual output responses thereby leading to more effective process control.

Another key feature of the present invention is determination of an output response for each degradation product in terms of an equivalent amount of additive. An output response is determined for each degradation product with regard to at least one performance aspect of the electroplated film. The performance aspect may be deposition rate, film roughness, or conductivity/purity which is dependent on C, N, S contamination, for example. Determination of output response preferably occurs during a set up phase and typically requires a first step of preparation or generation of multiple electroplating solutions having varying quantifiable concentrations of one or more degradation products. In one aspect, an electroplating solution may contain only one additive or one degradation product to determine an output response. Alternatively, an electroplating solution used for an output response measurement may contain a plurality of chemical species in known concentrations. Preferably, when comparing output responses from electroplating solutions each having multiple constituents, only one variable is changed from one plating solution to the next to enable a more direct interpretation and calculation of the results as demonstrated in Tables 1 and 2 below. Secondly, the constituents other than the additives and degradation products to be quantified are modulated so that the amount of other constituents is either negligible, process ineffective, or kept at a consistent level. A third step in output response determination is to evaluate process performance for the plating solutions formulated as a result of the first two steps described above. Occasionally, when the first and second steps above are not accomplished satisfactorily, statistical multivariate modeling techniques such as chemometrics may be utilized to determine a functional relationship between an output response and multiple bath constituents that may be varying simultaneously.

A method may need to be developed to measure and evaluate a certain output response when determining the effect of degradation products on plating bath performance. Note that the integrated process control method disclosed herein is focused on controlling quality in a nano scale environment such as integrated circuit (IC) manufacturing. One particular interest is minimizing the contamination in Cu films by carbon, nitrogen, and sulfur. The impact of degradation products through suppressing or elevating additive concentrations in plating baths due to interference in the analysis techniques is not addressed.

Figure 4:
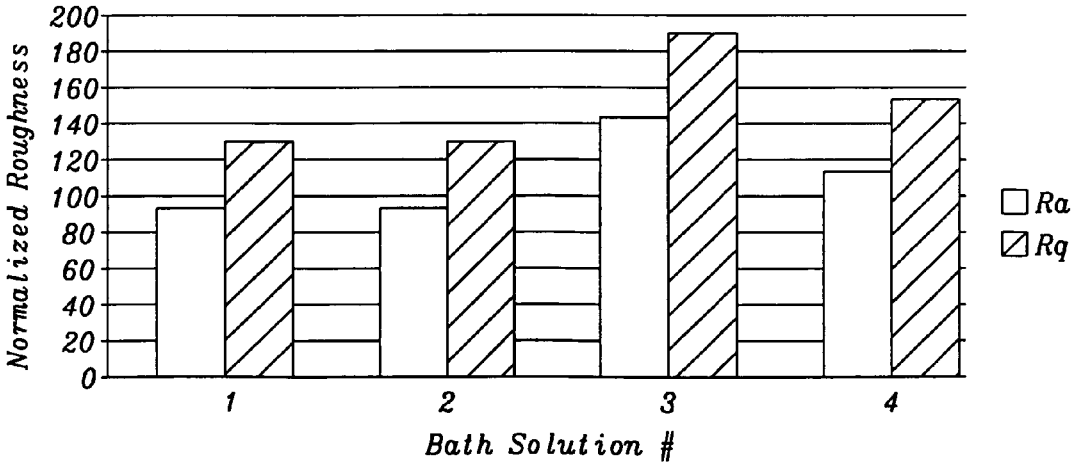
FIG. 4 is a bar graph that shows the variation in Ra (arithmetic average deviation of the absolute values of roughness profile from the mean) and Rq (geometric average deviation of the roughness profile from the mean) for different electroplating solutions.
Figure 5:
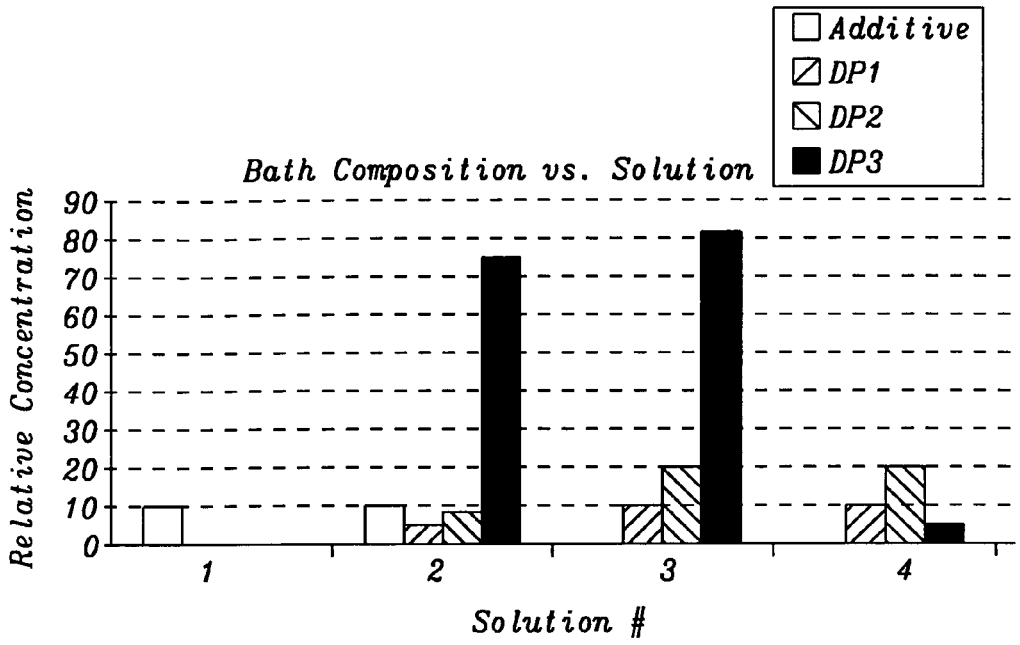
FIG. 5 is a bar graph showing that electroplating solutions with different concentrations of additive and degradation products may be used to determine the additive equivalent amount of a degradation product needed to replenish an additive in a plating bath according to a method of the present invention.

Referring to FIG. 4, four plating baths 1-4 are depicted and an output response (normalized roughness of the plated film) is measured in terms of Ra and Rq where Ra is arithmetic average deviation of the absolute values of roughness profile from the mean, and Rq is geometric average deviation of the roughness profile from the mean also known as root-mean-square (RMS). Roughness was measured for 3 micron thick Cu films using a stylus profiler. Bath 1 is a fresh commercial plating bath containing a target amount of additive. Bath 2 is a used bath with a target amount of additive and contains three decomposition products labeled DP1, DP2, and DP3. Bath 3 is a used bath with essentially all of the additive consumed and having higher concentrations of DP1, DP2, and DP3 than bath 2. Bath 4 has no additive and a very small concentration of degradation product DP3. The compositions of each of the four baths are also illustrated in the bar graphs in FIG. 5.

Assuming that roughness change (decrease) from bath 3 to bath 4 is a result of linear regression between roughness and DP3 concentration, then DP3 has a positive impact on roughness that decreases with a reduced DP3 concentration. Table 1 lists roughness reduction vs. sensor response intensity of DP3 in bath 3 and bath 4.

TABLE 1

| Correlation of Roughness with Degradation Product DP3 | | | |
|---|---|---|---|
| Bath # | DP3 (conc.) | Ra | Rq |
| 3 | 82 | 145 | 190 |
| 4 | 1 | 115 | 155 |
| Slope (Roughness/Unit DP3) | | 0.37 | 0.43 |

Table 2 lists roughness increase as a function of sensor intensity of additive in baths 2 and 3. Quantification here refers to measuring the quantity or sensor response of degradation products including DP3. In this example, the degradation product species are quantified with HPLC and/or mass spectrometry.

TABLE 2

| Correlation of Roughness with Additive | | | |
|---|---|---|---|
| Bath # | Additive | Ra | Rq |
| 2 | 10 | 93 | 131 |
| 3 | 0.5 | 145 | 190 |
| Slope (Roughness/Unit Additive) | | −5.47 | −6.21 |

A review of the data in Table 1 indicates, for example, a plating solution with 50 units of DP3 will increase Ra and Rq by 18.5 and 20.6, respectively, relative to a plating solution with no DP3. Likewise, the data in Table 2 is used to deduce that the additive equivalent amount required to produce the same Ra and Rq elevation as observed for 50 units DP3 is −3.4 and −3.5 units, respectively, for an average of −3.45 units of additive. In other words, 50 units of DP3 in a plating bath produce a response output for film roughness equivalent to an additive reduction of 3.45 units. Therefore, the additive equivalent amount ($C_F$) for 50 units of DP3 is −3.45 in this case which can also be expressed as $C_{F\ DP3}=-3.45$. It should be understood that an additive equivalent amount ($C_F$) could also be determined for DP1 and DP2. According to one embodiment of the present invention, the cumulative additive equivalent amounts for all degradation products are used to calculate a total $C_F$ for each additive in the plating bath. In the example provided, $C_{F\ Total}=C_{F\ DP1}+C_{F\ DP2}+C_{F\ DP3}$. Alternatively, in an embodiment wherein the plating solution comprises a plurality of additives and a plurality of "n" degradation products, the total $C_F$ for each additive may be expressed as $C_{F\ Total}=C_{F\ DP1}+C_{F\ DP2}+\ldots+C_{F\ DPn}$.

It is important to recognize that each $C_{F\ DPn}$ is determined by two factors which are (1) quantifying the concentration of degradation product $DP_n$ in the electroplating bath, and (2) calculating the equivalent amount of additive needed to generate the same output response as the measured amount of $DP_n$. Note that $DP_n$ concentration is constantly changing in the plating bath and must be repeatedly measured according to the present invention. Preset time intervals may be specified in the program used to control the sampling frequency. It follows that as the concentration of $DP_n$ changes, the equivalent amount of additive needed to produce the same output response will also change accordingly. For example, if DP3 is measured to be 100 units at a later stage in the electroplating process, then the additive equivalent amount will be also be twice as large (−6.7) as the additive equivalent amount previously calculated for 50 units DP3. However the ratio of $DP_n$ concentration/additive equivalent amount is assumed to be constant and for DP3 in the aforementioned example is 50/−3.45=100/−6.7=−14.92. Preferably, the ratio of $DP_n$ concentration/additive equivalent amount needs to be determined only once in a set up phase. During the manufacturing control phase, $DP_n$ concentration is repeatedly measured to enable an additive equivalent amount to be calculated for each sample taken from the plating bath.

Those skilled in the art will appreciate that $C_{F\ Total}$ and each of $C_{F\ DP1}$, and $C_{F\ DP2}$ up to $C_{F\ DPn}$ may be a negative value, a positive value, or zero. Furthermore, the integrated process control method described herein keeps a running estimate of $C_{F\ Total}$ for each additive and $C_{F\ DPn}$ for each degradation product species in the plating bath at specified time intervals during the manufacturing control phase. The estimate of $C_{F\ Total}$ varies as depletion causing events occur such as plating, aging, or dilution by addition of another chemical constituent. The present invention also anticipates that a degradation product DPn may have a different $C_{F\ DPn}$ value with respect to each additive in the plating solution. The present invention also accounts for concentration elevating events such as dosing, solvent evaporation, or generation of degradation product $DP_n$ by a chemical or electrochemical reaction. Thus, the present invention is compatible with other plating process control methods such as Smart Dosing (U.S. Pat. No. 6,471,845). Furthermore, the integrated process control method as defined herein may be incorporated into existing Closed Loop Control methods as appreciated by those skilled in the art.

According to one embodiment of the present invention, the manufacturing control phase comprises methods for separation, detection, quantification, and calculation of the total $C_F$ for each additive in the electroplating bath. In one aspect, identification methods and methods to determine the $DP_n$ concentration/additive equivalent amount ratio are performed only in the set up phase and do not need to be repeated in the manufacturing control phase unless there is an unexplained event related to a new unidentified degradation product. The separation methods, detection methods, quantification methods, determination of $C_{F\ DPn}$ for each plating bath sample, and calculation of total $C_F$ for each additive were described earlier with regard to the set up phase and are employed again during the manufacturing control phase.

During the manufacturing control phase, the electroplating bath is periodically replenished with one or more additives according to the following equation (1): $\Delta_{Additive}$=Nominal concentration−Measured concentration where nominal concentration means the target concentration as initially used in a new plating bath, and measured concentration is the amount of additive remaining in a used bath as provided by separation, detection, and quantification processes of the present invention. Furthermore, the amount of additive to be added to replenish the plating bath is represented by the equation (2): Addition amount=$\Delta_{Additive}+C_{F\ Total}$ where $C_{F\ Total}$ is determined periodically by withdrawing samples from the plating bath at specified time intervals to measure degradation product concentration by a separation method, detection method, and quantification method described previously. Thus, the integrated control process of the present invention is able to intelligently assign an amount of additive ($C_{F\ Total}$) that provides an equivalent output response to the amount of degradation products in the plating bath. In one embodiment, the addition amount may be required to reach a minimum predetermined value before an additive is actually added to replenish the plating bath. In other words, the addition amount may be so small that it cannot be measured or transferred accurately to the plating bath. In that case, the plating bath is not replenished until a subsequent sample indicates the addition amount is sufficiently large to accurately measure and transfer.

Alternatively, the amount of additive to be replenished may be determined by Addition amount=$a_i^t-a_i$. Up to this point in the industry, no distinction has been made between nominal (or target) concentration of an additive in the presence and absence of degradation products, because of the lack of clear realization that the optimal concentration of an additive for a targeted output response may be different when the bath contains or does not contain degradation products. If the term $T_i$ is the nominal concentration of an $i^{th}$ additive when the bath is free of degradation products, $a_i^t$ can be thought of the nominal concentration of the $i^{th}$ additive when degradation products are present, and $a_i$ is the measured additive concentration. To maintain the consistency with current terminology, $a_i^t$ can be called the effective additive nominal (or target) concentration, and $T_i$ continues to be referred to as the nominal concentration. In the event of zero degradation products, $a_i^t$ is equal to $T_i$.

The relationship between an output response and bath composition can be expressed as a function of concentrations of additive and degradation products, i.e. $R=f(a_1, a_2, a_3 - - - d_1, d_2, d_3 - - - d_j)$. To maintain same output response in the presence and absence degradation products, then $f(a_1^t, a_2^t, a_3^t - - - a_i^t, d_1, d_2, d_3 - - - d_j)-f(T_1, T_2, T_3 - - - T_i, 0, 0, 0 - - - 0)=0$, from which $a_i^t$ can be mathematically obtained. Addition amount can thus be obtained from the mathematically solved $a_i^t$ and measured $a_i$ as $(a_i^t-a_i)$. Furthermore, as determined from Addition amount=$\Delta+C_{F\ Total}=T_i-a_i+C_{F\ Total}$, the relationship between $C_{F\ Total}$, $a_i^t$ and $T_i$ is then $C_{F\ Total}$=Addition amount$-T_i+a_i=a_i^t-T_i$.

In summary, the addition amount can be obtained by Addition amount=$\Delta+C_{F\ Total}$=Nominal concentration−Measured concentration+$C_{F\ Total}$ or Addition amount=$a_i^t-a_i$, and $C_{F\ Total}$ can be obtained by $C_{F\ Total}=C_{F\ DP1}+C_{F\ DP2}+C_{F\ DP3} \ldots +C_{F\ DPn}$ or $C_{F\ Total}=a_i^t-T_i$. To be consistent with how electroplating tools are currently designed to receive bath concentration information to determine amount of additives to be dosed, it is preferred to use Addition amount=$\Delta+C_{F\ Total}$=Nominal concentration−Measured concentration+$C_{F\ Total}$. In such case, there is no need to change plating tools' software and the term (Measured concentration−$C_{F\ Total}$) is the input variable to be transmitted from the intelligent control system to plating tools.

How to develop a multivariate functional relationship between an output response R and multiple bath constituents $f(a_1^t, a_2^t, a_3^t - - - d_1, d_2, d_3 - - - d_j)$ is a subject covered by a number of textbooks such as "Chemometric Techniques for Quantitative Analysis" by Richard Kramer, Marcel Dekker, Inc., 1998, "Chemometrics for Pattern Recognition" by Richard Brereton, John Wiley & Sons, Ltd., 2009, "Multivariate Statistical Modeling Based on Generalized Linear Models", by Ludwig Fahrmeir and Gerhard Tutz, Springer-Verlag, 2001, "Advanced Linear Modeling, $2^{nd}$ Edition" by Ronald Christensen, Springer-Verlag, 2001, and "Multivariate Data Analysis in Practice, $5^{th}$ Edition" by Kim H. Esbensen, Multivariate Data Analysis, 2002, and commercial software programs such as Matlab with U.S. Pat. Nos. 6,857,118, 6,973,644, 6,993,772, 7,010,364, 7,051,333, 7,051,338, 7,096,154, 7,139,686, 7,165,253, 7,170,433, 7,181,745, 7,228,239, 7,231,631, 7,237,237, 7,340,441, 7,353,502, 7,359,805, 7,365,311, 7,369,127, 7,400,997, 7,428,737, 7,454,659, 7,454,746, 7,460,123, 7,500,220, 7,502,031, 7,502,745, 7,523,023, 7,523,440, 7,529,652, 7,542,888, 7,543,270, 7,558,712, 7,584,452, 7,605,814, 7,606,780, 7,606,833, 7,609,192, 7,610,578, 7,613,852, 7,624,372, 7,631,168, 7,634,530, 7,636,887, and 7,640,154. The knowledge with regard to how statistical multivariate modeling techniques work can be found in the aforementioned references, and is not a focus of the present invention.

Like $C_{F\ Total}$, the effective nominal concentration of an additive ($a_i^t$) varies as events occur such as plating, aging, dilution, dosing, solvent evaporation or introduction of a chemical or electrochemical reaction. The present invention anticipates that the aforementioned events may be used to modulate degradation products and one or both of $C_{F\ Total}$ and ($a_i^t$), which are a function of $DP_n$, to maintain an electroplating bath within a desired composition domain.

The integrated process control method of the present invention also anticipates that statistical data analysis may be applied to the data obtained during the set up phase and manufacturing control phase. Thus, the data generated by the quantification of additives and degradation products, and by calculation of $C_{F\ Total}$ during each sample analysis is preferably stored in a statistical process control (SPC) system so that trends can be tracked and information for individual samples taken at a specific time can be recalled at a later date. Moreover, the present invention encompasses model building techniques including but not limited to design of experiments, and chemometrics to develop separation, and quantification methods.

The present invention also includes an intelligent control system hereafter referred to as control system to continuously monitor and maintain a plating bath to provide consistent plating quality and improved reliability. For a Cu plating bath, output responses such as deposition rate, film roughness, conductivity, and grain size must be tightly controlled to guarantee a reliable product with high performance. An important feature of the control system as defined herein is its built-in interfaces with plating tools, factory automation equipment, and various speciation analyzers through an analyzer sampler. The methods and system of the present invention may be incorporated into current production lines without having to change equipment that is already deployed.

Figure 6:
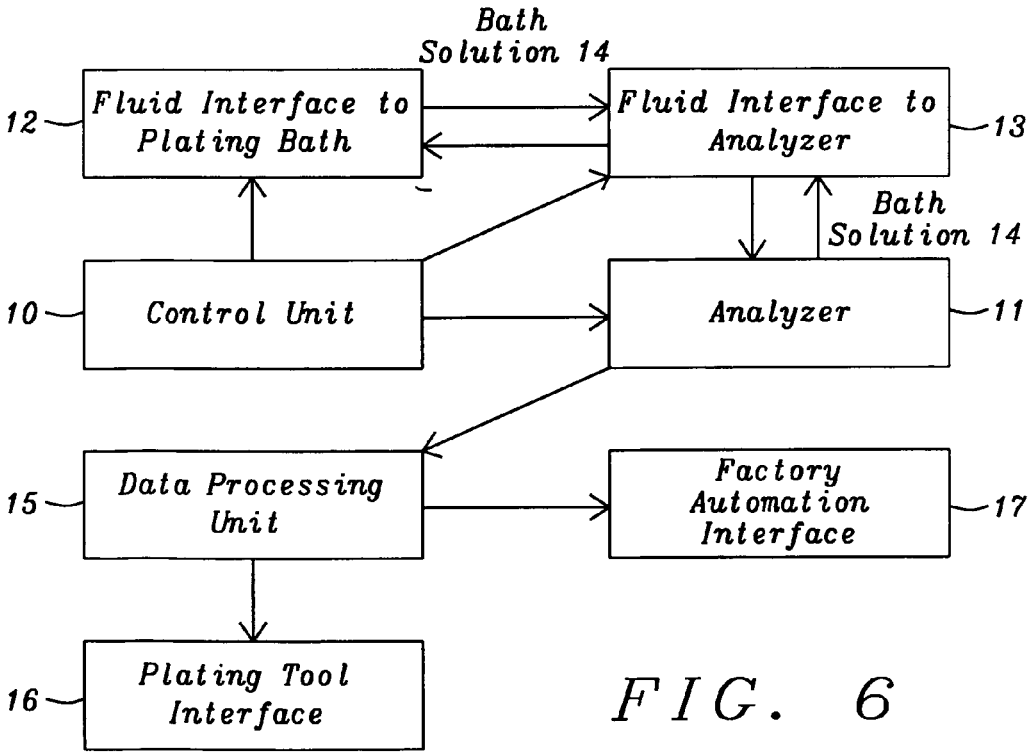
FIG. 6 depicts an intelligent control scheme for an electroplating operation according to one embodiment of the present invention.

Referring to FIG. 6, the control system of the present invention is depicted in the form of a flow chart. As mentioned previously, there is a fluid interface 12 to the plating bath 14 and a fluid interface 13 to an analyzer 11 wherein the analyzer comprises a plurality of analytical instruments including HPLC, UHPLC, or ULPC, mass spectrometry, CVS, and RTA. The analyzer may also include Raman spectroscopy, NMR, FT-IR, near IR, UV-VIS spectroscopy, and other instruments that are relied upon to perform one or more separation, detection, identification, and quantification methods with regard to a chemical species in the plating bath. A control unit 10 is connected to valves that control fluid interfaces 12, 13 and is able to issue commands to collect samples at preset intervals and direct the flow of a portion of plating bath solution 14 to the analyzer 11.

Figure 7:
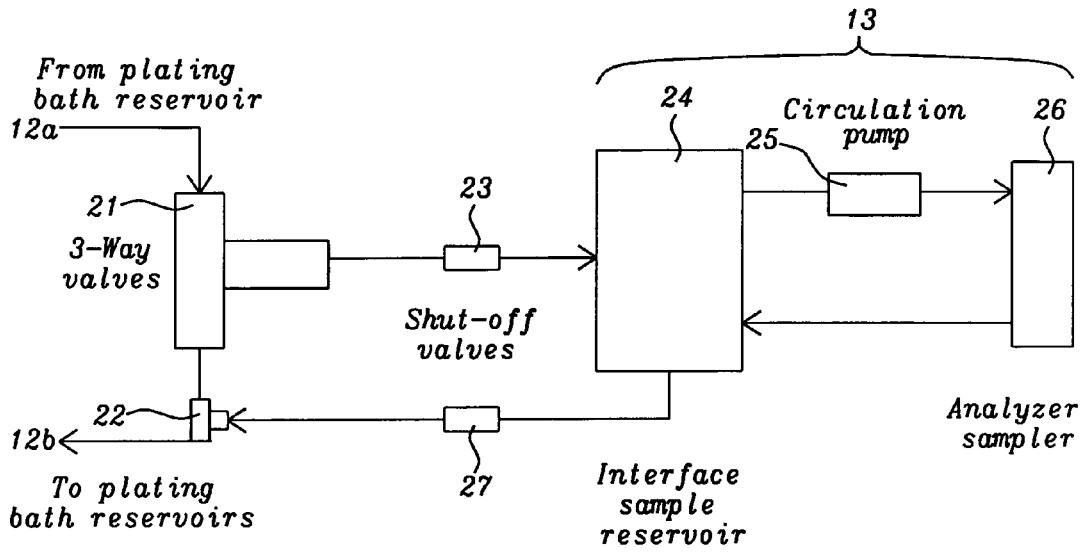
FIG. 7 shows an enlargement of the fluid interfaces to plating bath and analyzer illustrated in FIG. 6 according to one embodiment of the present invention.

According to the exemplary embodiment depicted in FIG. 7, plating bath interface 12 may include two ports 12*a*, 12*b* wherein the flow of liquid from the plating bath 14 through port 12*a* proceeds through a tube to a three way valve 21. At certain times when samples for analysis are not needed, two openings in three way valve 21 and in adjacent three way valve 22 allow a continuous circulation loop from plating bath 14 through interface 12*a*, three way valves 21, 22, and back to the plating bath through interface 12*b*. Fluid interface to speciation analyzer 13 consists of an interface sample reservoir 24 and a circulation loop including circulation pump 25 between the interface sample reservoir and analyzer sampler 26. Shut off valves 23, 27 are open when plating bath solution is circulating to fill the interface bath reservoir 24 while circulation pump 25 is turned off. This flow configuration may remain operational until an analysis is to be performed. When a command is received from control unit 10 via a communication link (not shown), shut off valves 23, 27 are closed and the circulation pump 25 starts to circulate plating bath solution (sample) between the interface sample reservoir 24 and analyzer sampler 26. Analyzer sampler 26 distributes plating bath solution to one or more analytical speciation instruments (analyzer 11) when directed to do so through a communication link (not shown) to control unit 10. Once sampling is complete, circulation pump 25 is turned off and shut off valves 23, 27 are reopened until a subsequent sample is required. In addition to controlling the shut off valves 23, 27 and analyzer sampler 26, control unit 10 (FIG. 6) switches the circulation pump on and off and also hosts interlocks related to safety and facility connections.

There is a data processing unit 15 that receives data generated by speciation analyzer 11. The data typically includes output responses from each of the analytical instruments (collectively referred to as speciation analyzer 11) relied upon for separation, detection, identification, and quantification purposes. Data processing unit 15 also calculates the additive equivalent amount $C_{F\,Total}$ for each additive in the plating bath and the addition amount based on equation (2) presented previously.

Figure 8:
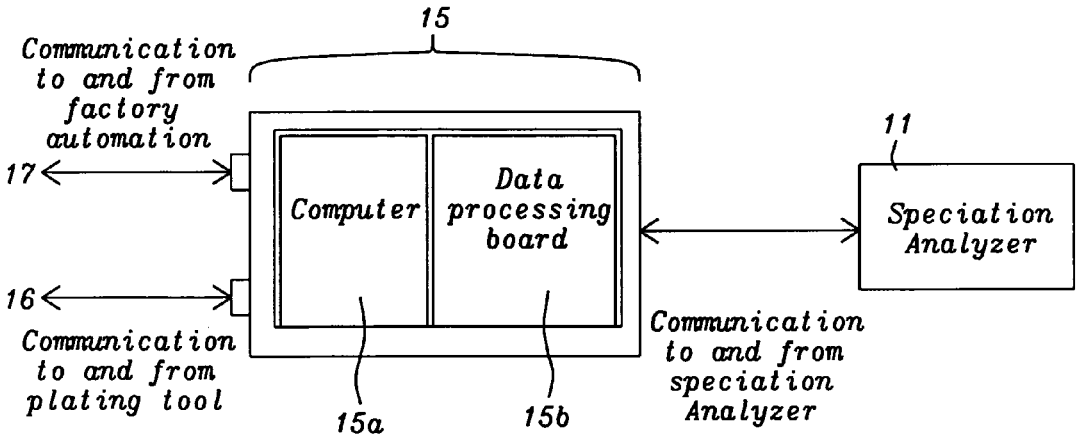
FIG. 8 shows an enlargement of the data processing unit and links to other components in the control system according to one embodiment of the present invention.

Referring to FIG. 8, data processing unit 15 comprises a computer 15*a* and data processing board 15*b* that receives and/or digitizes analytical data from speciation analyzers. Once an original set of concentrations or sensor responses of plating bath additives and degradation products are available, the data processing unit 15 transforms the data from speciation analyzer 11 into a new set of data used as input variables which are transmitted through plating tool interface 16 to the plating tool dosing system. Plating tool control variables are typically designed in terms of concentration of additives. Therefore, input variables transmitted from data processing unit 15 are conveniently expressed in terms of concentrations of chemical species as well and can be logically thought of as concentrations of bath additives corrected for the contributions of degradation products towards deposition properties, film properties, or device performance.

In a preferred embodiment, corrected concentration values are transmitted from data processing unit 15 through interfaces 16, 17 to plating tools and factory automated equipment, respectively. Furthermore, original (uncorrected) concentrations of additives and degradation products (or sensor responses of degradation products) are transmitted through interfaces 16, 17 to plating tools and factory automated equipment, respectively. Factory automated equipment may comprise one or more computers that manufacturing operators access to monitor SPC for plating bath 14 and track the data generated by speciation analyzer 11. The data may be used as a reference by the operators to evaluate system performance.

Those skilled in the art will appreciate that plating tool interface 16 and factory automation interface 17 include communication ports, cables, and a client program residing on the data processing unit computer 15*a* to facilitate communication with plating tools and factory automation equipment. According to one embodiment of the present invention, data processing unit 15 sends corrected concentration data to plating tools and/or factory automation equipment in response to a command "Send Data", and sends uncorrected data to plating tools and/or factory automation equipment in response to a command "Send Original Data". Thereafter, plating tools and/or factory automation equipment can take the following actions pending the concentrations received relative to their target values, and process alarm and fault limits: (1) take no action; (2) add a certain amount of one or more additives to reset the plating bath solution 14; (3) send an alarm to operators and then continue normal electroplating operations; or (4) shut down plating tools.

Data processing unit 15 also serves to send bath metrology status information regarding the control system and speciation analyzer 11 to plating tools and to factory automated equipment for manufacturing operators to monitor. For example, data processing unit 15 may send a message "Ready" in response to an inquiry about whether or not the metrology/control system is operation ready. In this context, the term metrology refers to the collection of speciation analyzers that detect, identify, and quantify additives and degradation products. Furthermore, data processing unit 15 sends diagnostic information to plating tools and/or factory automated equipment when the metrology/control system is not in an operation ready state. In addition, data processing unit provides monitoring data with regard to the metrology/control system condition (pristine or compromised state), and sends reminders for upcoming and past due preventative maintenance activities. In general, a data processing unit 15 may be programmed to send whatever information is deemed important by operators and requested by plating tools and factory automated equipment, and can vary from facility to facility.

It should be understood that plating bath solution 14 may be obtained from a central reservoir that feeds a plurality of plating baths, or may be taken from a stand alone plating bath, or from a plating bath that is connected in series to one or more additional plating baths in a continuous loop arrangement. In a preferred embodiment, when an additive adjustment is made to replenish a central reservoir, all electroplating baths interconnected with the central reservoir have a composition that is adjusted accordingly after a certain amount of time to allow circulation of the reservoir solution through all of the interconnected plating baths. Therefore, controlling the electroplating solution in a central reservoir is an efficient way to maintain control over a plurality of electroplating baths supplied by the central reservoir.

An important feature of the control system is that the data collected by analyzer 11 includes the concentration of both additives and degradation products in the plating bath 14 unlike prior art control systems that only monitor additives or perform analyses that represent a response from a combination of components. One benefit of the present invention is that the integrated process control method and system disclosed herein enables a more precise control of additive concentrations in electroplating baths for fabricating high value electronic parts. As a result, the bleed-and-feed rate that is utilized in current processes can be significantly reduced to achieve a substantial savings in terms of a lower cost of chemicals, and lower cost in disposing used bath solutions. The reduction of chemical consumption and disposal is a significant step in moving the electroplating industry towards a more "green" environmentally friendly process. Another important advantage is the present invention provides a more complete analysis of additives and degradation products in plating baths than prior art technology and thereby minimizes the frequency of unexplained plating bath events and process outliers and their associated costs.

While this invention has been particularly shown and described with reference to, the preferred embodiment thereof, it will be understood by those skilled in the art that various changes in form and details may be made without departing from the spirit and scope of this invention.

I claim:

1. An integrated process control method for controlling an electroplating bath that is used to deposit an electroplated film on a substrate, comprising:

(a) an additive's effective nominal (target) concentration that is a nominal concentration of a first additive in the presence of "n" degradation products in addition to a plurality of other additives where n is an integer ≤1 and is determined according to the equation:

effective nominal concentration=nominal concentration +additive equivalent amount wherein (1) the nominal concentration is the target concentration of an additive in a new electroplating bath, or in a working electroplating bath under significant bleed and feed in which the concentration of degradation products are kept low and (2) the additive equivalent amount of an additive is the amount of the additive that would produce the same electroplating effect as the presence of the degradation products in an electroplating bath;

(b) calculating an amount of the first additive and each of the plurality of additives (addition amount) required to replenish the consumed additives at periodic intervals according the equation:

addition amount=effective nominal concentration −measured concentration wherein the measured concentration is the concentration of the additive in the electroplating bath determined by one or more analytical speciation techniques; and (c) replenishing the electroplating bath by adding the additive amount of the first additive and each of the plurality of additives.

2. The integrated process control method of claim 1 further comprising:

(a) quantifying an amount of the first additive and each of the plurality of additives in said electroplating bath by using one or more analytical speciation techniques;

(b) quantifying an amount of "n" degradation products produced by said first additive and the plurality of additives in a used electroplating bath, said degradation products are identified as $DP_1$, $DP_2$, . . . $DP_n$, where n is an integer ≤1;

(c) determining a response output for each of said "n" degradation products with regard to at least one performance aspect of the electroplated film;

(d) determining, for each of said "n" degradation products, an additive equivalent amount ($C_F$) of the first additive and each of the plurality of additives that would produce the same response output as the measured amount of the degradation product;

(e) calculating an amount of the first additive and each of the plurality of additives (addition amount) required to replenish the consumed additives at periodic intervals according to the equations:

$$\Delta_{Additive}=\text{nominal concentration}-\text{measured concentration} \quad (1)$$

$$\text{addition amount}=\Delta_{Additive}+C_{F\ Total} \quad (2)$$

where $C_{F\ Total}$ equals to the sum of $C_{F\ DP1}+C_{F\ DP2}+\ldots+C_{F\ DPn}$ wherein each of the values in the aforementioned sum represents the additive equivalent amount, respectively, for each of said "n" degradation products in the electroplating bath.

3. The integrated process control method of claim 2 wherein each of the terms $C_{F\ Total}$, $C_{F\ DP1}$, $C_{F\ DP2}$, up to $C_{F\ DPn}$ has a negative value, a positive value, or is zero.

4. The integrated process control method of claim 2 wherein an amount of additive (addition amount) required to replenish the consumed additives at periodic intervals is calculated alternatively according to the equations:

$$f(a_1^t, a_2^t, a_3^t - - - a_i^t, d_1, d_2, d_3 - - - d_j) - f(T_1, T_2, T_3 - - - T_i, 0, 0, 0 - - - 0) = 0 \quad (1)$$

where f is the functional relationship between response output and bath composition, $a_i^t$ is the effective nominal concentration of an $i^{th}$ additive $d_j$ is the concentration of a $j^{th}$ degradation product, and $T_i$ is the nominal concentration of the $i^{th}$ additive;

$$\text{addition amount}=a_i^t-a_i \quad (2)$$

where $a_i$ is the measured concentration of the $i^{th}$ additive.

5. The integrated process control method of claim 2 wherein $C_{F\ Total}$ is calculated alternatively according to the equations:

$$f(a_1^t, a_2^t, a_3^t - - - a_i^t, d_1, d_2, d_3 - - - d_j) - f(T_1, T_2, T_3 - - - T_i, 0, 0, 0 - - - 0) = 0 \quad (1)$$

where f is the functional relationship between a response output and bath composition, $a_i^t$ is the effective nominal concentration of an $i^{th}$ additive, $d_j$ is the concentration of a $j^{th}$ degradation product, and $T_i$ is the nominal concentration of the $i^{th}$ additive:

$$C_{F\ Total}=a_i^t-T_i. \quad (2)$$

6. The integrated process control method of claim 2 wherein the analytical speciation techniques are selected from HPLC, UHPLC or ULPC, mass spectrometry, FT-IR, near IR, Raman spectroscopy, CVS, RTA, UV-VIS spectroscopy, and nuclear magnetic resonance (NMR).

7. The integrated process control method of claim 2 wherein quantifying the amount of "n" degradation products produced by the additives is performed with one or more of HPLC, UHPLC or ULPC, mass spectrometry, FT-IR, near IR, UV-VIS spectroscopy, Raman spectroscopy, and NMR.

8. The integrated process control method of claim 2 wherein determining a response output for each degradation product with regard to at least one performance aspect comprises:

(a) preparing or generating a plurality of electroplating bath solutions having varying quantifiable amounts of one or more degradation products which are constituents;

(b) modulating other constituents in the plating bath so that the amount of said other constituents is either negligible, process ineffective, or kept at a constant level;

(c) evaluating process performance using plating bath solutions from the aforementioned two steps.

9. The integrated process control method of claim 2 wherein steps (a)-(e) are repeated at a plurality of preset intervals to generate a plurality of samples and a set of data associated with each sample that can be stored in a data processing unit, plating tool, or factory automation equipment to generate SPC data which can be used for tracking purposes.

10. The integrated process control method of claim 2 further comprising model building techniques involving one or more of design of experiments, and chemometrics.

11. The integrated process control method of claim 2 wherein events including plating, aging, dilution, dosing, solvent evaporation or introduction of a chemical or electrochemical reaction can be used to modulate degradation products and $C_{F\ Total}$ to maintain an electroplating bath within a desired composition domain.

12. The integrated process control method of claim 4 wherein events including plating, aging, dilution, dosing, solvent evaporation or introduction of a chemical or electrochemical reaction can be used to modulate degradation products and $C_{F\ Total}$ or ($a_i^{\ t}$) to maintain an electroplating bath within a desired composition domain.

13. The integrated process control method of claim 5 wherein events including plating, aging, dilution, dosing, solvent evaporation or introduction of a chemical or electrochemical reaction can be used to modulate degradation products and $C_{F\ Total}$ or ($a_i^{\ t}$)to maintain an electroplating bath within a desired composition domain.

14. The integrated process control method of claim 1 further comprising the steps of (a) separating a plurality of additives and degradation products in an electroplating bath wherein each of the additives and degradation products may be collected as an essentially pure chemical species;

(b) detecting and identifying each of the plurality of additives and degradation products collected in step (a);

(c) quantifying the concentration of each of the plurality of additives and degradation products in said electroplating bath;

(d) determining an output response for each degradation product with regard to an additive equivalent amount that produces an equal output response related to a certain aspect of performance;

(e) calculating the amount of one or more additives to be added to replenish the electroplating bath based on the amount of degradation products from step (c) and their output response determined by step (d).

15. The integrated process control method of claim 14 wherein separating additives and degradation products comprises a high pressure liquid chromatography (HPLC) method.

16. The integrated process control method of claim 14 wherein the detecting, identifying and quantifying methods comprise one or more of HPLC, UHPLC or ULPC, mass spectrometry, Raman spectroscopy, FT-IR, near IR spectroscopy, UV-VIS spectroscopy, CVS, RTA, and NMR.

17. The integrated process control method of claim 14 wherein calculating the amount of one or more additives (addition amount) to replenish the consumed additives at periodic intervals comprises the equations:

$$\Delta_{Additive}=\text{nominal concentration}-\text{measured concentration} \quad (1)$$

and $$\text{addition amount}=\Delta_{Additive}+C_{F\ Total} \quad (2)$$

where $C_{F\ Total}$ equals to the sum of $C_{F\ DP1}+C_{F\ DP2}+\ldots+C_{F\ DPn}$ wherein each of the values in the aforementioned sum represents the additive equivalent amount, respectively, for each of said "n" degradation products ($DP_1, DP_2, \ldots DP_n$)in the electroplating bath where n≥1.

18. The integrated process control method of claim 14 wherein calculating an amount of one or more additives (addition amount) required to replenish the consumed additives at periodic intervals is comprised of the equations:

$$f(a_1^t, a_2^t, a_3^t \ldots a_i^t, d_1, d_2, d_3 \ldots d_j)-f(T_1, T_2, T_3 \ldots T_i, 0, 0, 0 \ldots 0)=0 \quad (1)$$

where f is the functional relationship between a response output and bath composition, $a_i^t$ is the the effective nominal concentration of an $i^{th}$ additive, $d_j$ is the concentration of a $j^{th}$ degradation product, and $T_i$ is the nominal concentration of the $i^{th}$ additive;

$$\text{addition amount}=a_i^t-a_i; \quad (2)$$

where a; is the measured concentration of the $i^{th}$ additive.

19. The integrated process control method of claim 17 wherein $C_{F\ Total}$ is calculated alternatively according to the equations:

$$f(a_1^t, a_2^t, a_3^t, d_1, d_2, d_3 \ldots d_n)-f(T_1, T_2, T_3, 0, 0, 0 \ldots 0)=0 \quad (1)$$

where f is the functional relationship between response output and bath composition, $a_i^t$ is the effective nominal concentration of an $i^{th}$ additive, $d_j$ is the concentration of a $j^{th}$degradation product, and $T_i$ is the nominal concentration of the $i^{th}$ additive;

$$C_{F\ Total}=a_i^{t-T_i}. \quad (2)$$

20. The integrated process control method of claim 17 wherein events including plating, aging, dilution, dosing, solvent evaporation, or introduction of a chemical or electrochemical reaction can be used to modulate degradation products and $C_{F\ Total}$ to maintain an electroplating bath within a desired composition domain.

21. The integrated process control method of claim 18 wherein events including plating, aging, dilution, dosing, solvent evaporation, or introduction of a chemical or electrochemical reaction can be used to modulate degradation products and $C_{F\ Total}$ or ($a_i^t$) to maintain an electroplating bath within a desired composition domain.

22. The integrated process control method of claim 19 wherein events including plating, aging, dilution, dosing, solvent evaporation, or introduction of a chemical or electrochemical reaction can be used to modulate degradation products and $C_{F\ Total}$ or ($a_i^t$) to maintain an electroplating bath within a desired composition domain.

* * * * *